US011048202B2

(12) United States Patent
Hayashi

(10) Patent No.: US 11,048,202 B2
(45) Date of Patent: Jun. 29, 2021

(54) SHEET CONVEYANCE APPARATUS HAVING PAPER DUST REMOVAL AND IMAGE FORMING APPARATUS

(71) Applicant: CANON KABUSHIKI KAISHA, Tokyo (JP)

(72) Inventor: Naoki Hayashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 166 days.

(21) Appl. No.: 16/381,250

(22) Filed: Apr. 11, 2019

(65) Prior Publication Data

US 2019/0324396 A1 Oct. 24, 2019

(30) Foreign Application Priority Data

Apr. 23, 2018 (JP) ..... JP2018-082573

(51) Int. Cl.
*G03G 21/00* (2006.01)
*G03G 15/00* (2006.01)

(52) U.S. Cl.
CPC ..... *G03G 21/0058* (2013.01); *G03G 15/6573* (2013.01); *G03G 2221/001* (2013.01); *G03G 2221/0026* (2013.01); *G03G 2221/0042* (2013.01); *G03G 2221/0089* (2013.01)

(58) Field of Classification Search
CPC ..... G03G 21/0058; G03G 15/6573; G03G 15/6558; G03G 2221/001; G03G 2221/0089; G03G 2221/0026; G03G 2221/0042
See application file for complete search history.

(56) References Cited

U.S. PATENT DOCUMENTS

| | | | | |
|---|---|---|---|---|
| 8,752,823 | B2 | 6/2014 | Hayashi et al. | |
| 9,016,690 | B2 | 4/2015 | Fukunaga | |
| 2008/0310896 | A1* | 12/2008 | Shono | G03G 21/0029 399/350 |

FOREIGN PATENT DOCUMENTS

| | | | |
|---|---|---|---|
| JP | 2003-267579 | A | 9/2003 |
| JP | 2004-189445 | A | 7/2004 |
| JP | 2007-197215 | A | 8/2007 |
| JP | 2015-006950 | A | 1/2015 |

* cited by examiner

*Primary Examiner* — Joseph S Wong
(74) *Attorney, Agent, or Firm* — Venable LLP

(57) ABSTRACT

A sheet conveyance apparatus includes a conveyance portion including a rotary member, and a counter member, a first contact member, a second contact member, and a contacting and separating mechanism. The contacting and separating mechanism causes the second contact member to separate from the surface of a rotary member of a conveyance portion when the rotary member rotates in the first direction, and causes the second contact member to abut against the surface of the rotary member when the rotary member rotates in a second direction opposite to the first direction.

13 Claims, 6 Drawing Sheets

SHEET CONVEYANCE APPARATUS HAVING PAPER DUST REMOVAL AND IMAGE FORMING APPARATUS

BACKGROUND OF THE INVENTION

Field of the Invention

The present invention relates to a sheet conveyance apparatus for conveying a sheet and an image forming apparatus including the same.

Description of the Related Art

In general, a printer of an electrophotographic system transfers a toner image formed on a photosensitive drum to a sheet fed from a cassette, fixes the toner image on the sheet, and then discharges the sheet outside the apparatus. Paper dust may be generated on the sheet due to rubbing between a conveyance roller, a separating pad, and the like, and paper dust adheres to the photosensitive drum or toner, which causes deterioration of image quality.

Hitherto, an image forming apparatus including a first paper dust removing roller coming into contact with a sheet to capture paper dust on the sheet and a first sponge member scraping paper dust adhering to the first paper dust removing roller has been proposed (see JP-A-2003-267579). In the image forming apparatus, in a case where the first paper dust removing roller rotates in a forward rotation direction, paper dust is scraped by the first sponge member, but when the first paper dust removing roller rotates in a reverse rotation direction, there is a concern that paper dust scraped by the first sponge member flows back to a conveyance path. Therefore, in the forward rotation direction of the first paper dust removing roller, a first reverse conveyance preventing member for scraping paper dust from the first paper dust removing roller is provided upstream of the first sponge member. In a case where the first paper dust removing roller rotates in the reverse rotation direction, paper dust is scraped by the first reverse conveyance preventing member.

A slight gap is provided between the first paper dust removing roller and the first reverse conveyance preventing member, so that scraping of paper dust by the first sponge member when the first paper dust removing roller rotates in the forward rotation direction is not inhibited. When the first paper dust removing roller rotates in the forward rotation direction, the gap allows conveyance of paper dust toward the first sponge member and when a second paper dust removing roller rotates in the reverse rotation direction, the gap limits the conveyance of paper dust to a conveyance path as a certain lump.

However, although the first reverse conveyance preventing member described in JP-A-2003-267579 can restrict the conveyance of paper dust which has become a large lump, for example, paper dust having a small particle size mainly composed of a filler of the sheet or the like may pass through the gap. Therefore, the paper dust passing through the gap adheres to the photosensitive drum or the toner and there is a concern that image defects occur.

SUMMARY OF THE INVENTION

According to one aspect of the present invention, a sheet conveyance apparatus includes a conveyance portion including a rotary member, and a counter member facing the rotary member so as to form a conveyance nip together with the rotary member, the conveyance portion being configured to convey a sheet at the conveyance nip by the rotary member rotating in a first direction, a first contact member configured to come into contact with a surface of the rotary member at a first position, a second contact member configured to come into contact with the surface of the rotary member at a second position located downstream of the conveyance nip and upstream of the first position in the first direction, and a contacting and separating mechanism configured to abut the second contact member against the surface of the rotary member and separate the second contact member from the surface of the rotary member. The contacting and separating mechanism causes the second contact member to separate from the surface of the rotary member when the rotary member rotates in the first direction, and causes the second contact member to abut against the surface of the rotary member when the rotary member rotates in a second direction opposite to the first direction.

Further features of the present invention will become apparent from the following description of exemplary embodiments with reference to the attached drawings.

DESCRIPTION OF THE EMBODIMENTS

First Embodiment

Overall Configuration

Figure 1:
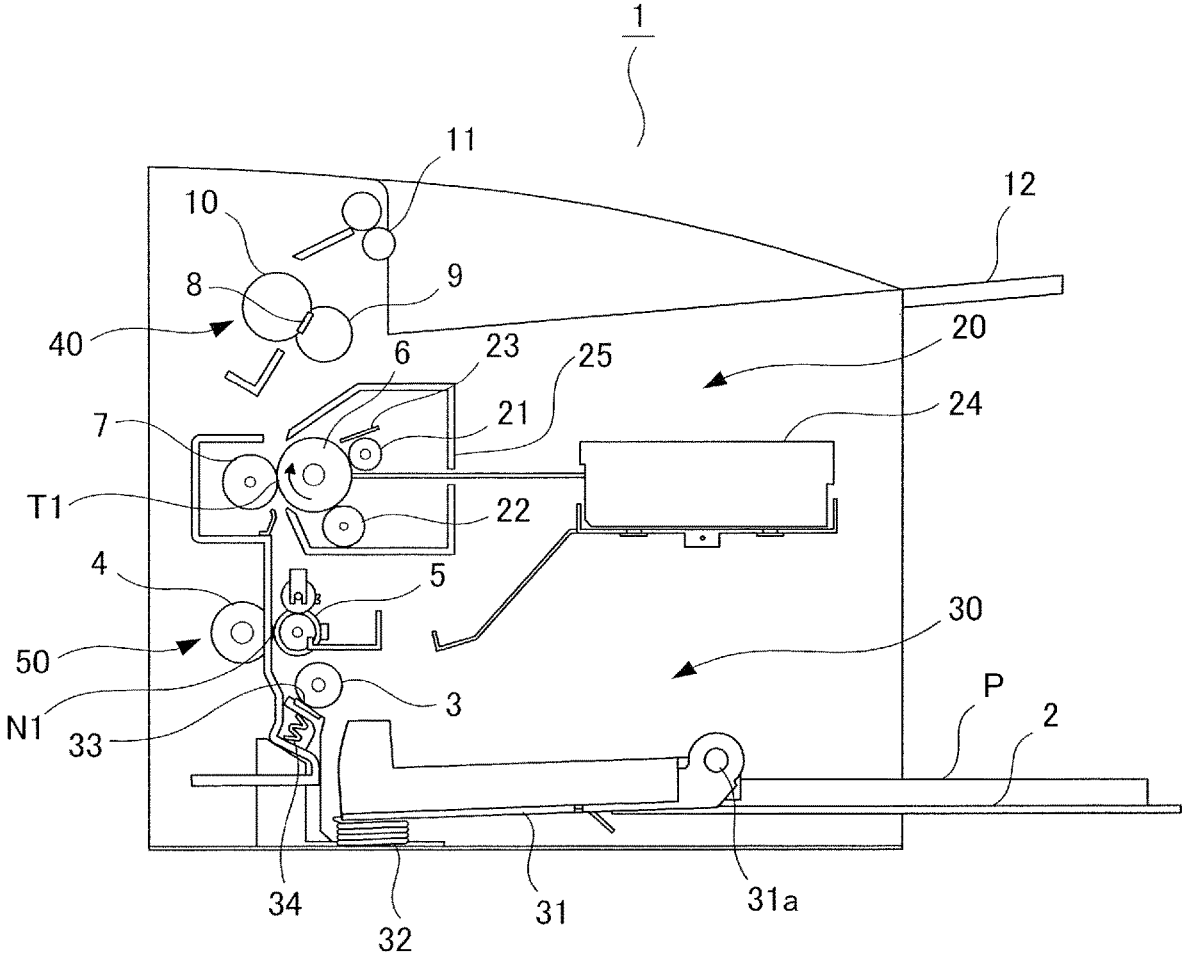
FIG. 1 is an overall schematic view illustrating a printer according to a first embodiment.

First, a first embodiment of the invention will be described. A printer 1 as an image forming apparatus is a laser beam printer of an electrophotographic system for forming a monochrome toner image. As illustrated in FIG. 1, the printer 1 includes a sheet feeding apparatus 30 feeding a stacked sheet, and a sheet conveyance apparatus 50 conveying the sheet fed by the sheet feeding apparatus 30. In addition, the printer 1 includes an image forming unit 20 forming an image on the sheet conveyed by the sheet conveyance apparatus 50, a fixing unit 40 fixing the image transferred to the sheet, and a sheet discharge roller pair 11 capable of discharging the sheet to a sheet discharge tray 12.

When an image forming command is output to the printer 1, an image forming process is started by the image forming unit 20 based on image information input from an external computer or the like connected to the printer 1. The image forming unit 20 includes a process cartridge 25, a laser scanner 24, and a transfer roller 7. The process cartridge 25 includes a photosensitive drum 6 rotating in an arrow direction, and a charge roller 21, a developing roller 22, and a cleaning blade 23 which are disposed along the photosensitive drum 6. The photosensitive drum 6 and the transfer roller 7 form a transfer nip T1. The process cartridge 25 is detachable from an apparatus body of the printer 1.

The laser scanner 24 radiates a laser beam toward the photosensitive drum 6 based on the input image information. In this case, the photosensitive drum 6 is precharged by the charge roller 21 and is irradiated with the laser beam, so that an electrostatic latent image is formed on the photosensitive drum 6. Thereafter, the electrostatic latent image is developed by the developing roller 22 and the monochrome toner image is formed on the photosensitive drum 6.

In parallel to the image forming process, a sheet P is fed from the sheet feeding apparatus 30. The sheet feeding apparatus 30 has a stacking portion 2 capable of stacking a sheet and a downstream side in a feeding direction of the sheets stacked on the stacking portion 2 is supported by a sheet supporting portion 31. The sheet supporting portion 31 is pivotably supported around a pivot shaft 31*a* and is urged upward by a spring 32. The sheet supporting portion 31 is pressed downward against an urging force of the spring 32 by a cam (not illustrated) every time one sheet is fed. The sheets P supported by the sheet supporting portion 31 are fed by a feed roller 3 and are separated one by one by a separating pad 33 urged toward the feed roller 3 by a spring 34.

The sheet conveyance apparatus 50 includes a driving roller 4 as a counter member and a driven roller 5 as a rotary member for forming a conveyance nip N1, and the sheets P which are separated one by one are conveyed toward the transfer nip T1 by the conveyance nip N1. The driving roller 4 and the driven roller 5 may constitute a registration roller pair for correcting a skew of the sheet P by causing a distal end of sheet P to abut against the conveyance nip N1.

The toner image on the photosensitive drum 6 is transferred to the sheet P conveyed by the conveyance nip N1 by an electrostatic load bias applied to the transfer roller 7 at the transfer nip T1. Residual toner remaining on the photosensitive drum 6 is recovered by the cleaning blade 23. A predetermined heat and pressure are applied to the sheet P to which the toner image is transferred by the fixing unit 40, and the toner is melted and fixed. The fixing unit 40 includes a heating roller 9 having a heater 8 and a pressure roller 10. The sheet P passed through the fixing unit 40 is discharged to the sheet discharge tray 12 by the sheet discharge roller pair 11.

The printer 1 of the embodiment has a configuration capable of only single-side printing, but may have a configuration in which a duplex conveyance path is provided downstream of the fixing unit 40 in the sheet conveyance direction and the sheet P where an image is formed on a first surface is guided again to the transfer nip T1 by the duplex conveyance path.

Sheet Conveyance Apparatus

Next, the sheet conveyance apparatus 50 will be described in detail with reference to FIG. 2. In the embodiment, as illustrated in FIG. 2A, two sheet conveyance apparatuses 50 are juxtaposed in a width direction (arrow Y direction in the drawing) of the sheet on a drive shaft 4*a* driven by a motor M as a drive source, and the two sheet conveyance apparatuses 50 have the same configuration.

The sheet conveyance apparatus 50 includes a conveyance portion 45 conveying the sheet in the conveyance nip N1, a sponge 13 as a first contact member, a backflow preventing member 14 as a second contact member, and a contacting and separating mechanism 60. The conveyance portion 45 includes the driving roller 4 driven by the drive shaft 4*a* and the driven roller 5 driven to rotate by the driving roller 4. The driving roller 4 faces the driven roller 5. The driven roller 5 includes a sheet conveyance surface 5*b* as a surface abutting against a peripheral surface of the driving roller 4 to form the conveyance nip N1 and a pair of sliding surfaces 5*a* disposed on both sides of the sheet conveyance surface 5*b* in the axial direction. The driven roller 5 is urged toward the driving roller 4 by a spring (not illustrated). That is, the sheet conveyance surface 5*b* serves as a roller portion that comes into contact with the sheet to convey the sheet.

The sponge 13 is held by a sponge holding member (not illustrated) and contacts with the sheet conveyance surface 5*b* of the driven roller 5 with a predetermined abutting pressure. The backflow preventing member 14 is made of a material such as MYLAR (registered trademark) which is a polyester resin and is urged toward the sheet conveyance surface 5*b* of the driven roller 5 by its own weight and a spring 104. The backflow preventing member 14 is capable of abutting against the sheet conveyance surface 5*b* at a second position downstream of the conveyance nip N1 and upstream of the first position where the sponge 13 contacts with the sheet conveyance surface 5*b* in an arrow B1 direction illustrated in FIG. 3A. The sponge 13 and the backflow preventing member 14 are formed to be longer than the sheet conveyance surface 5*b* in the width direction, and come into contact with the sheet conveyance surface 5*b*, so that paper dust adhering to the sheet conveyance surface 5*b* can be scraped through an overall region in the width direction to be removed.

Figure 2A:
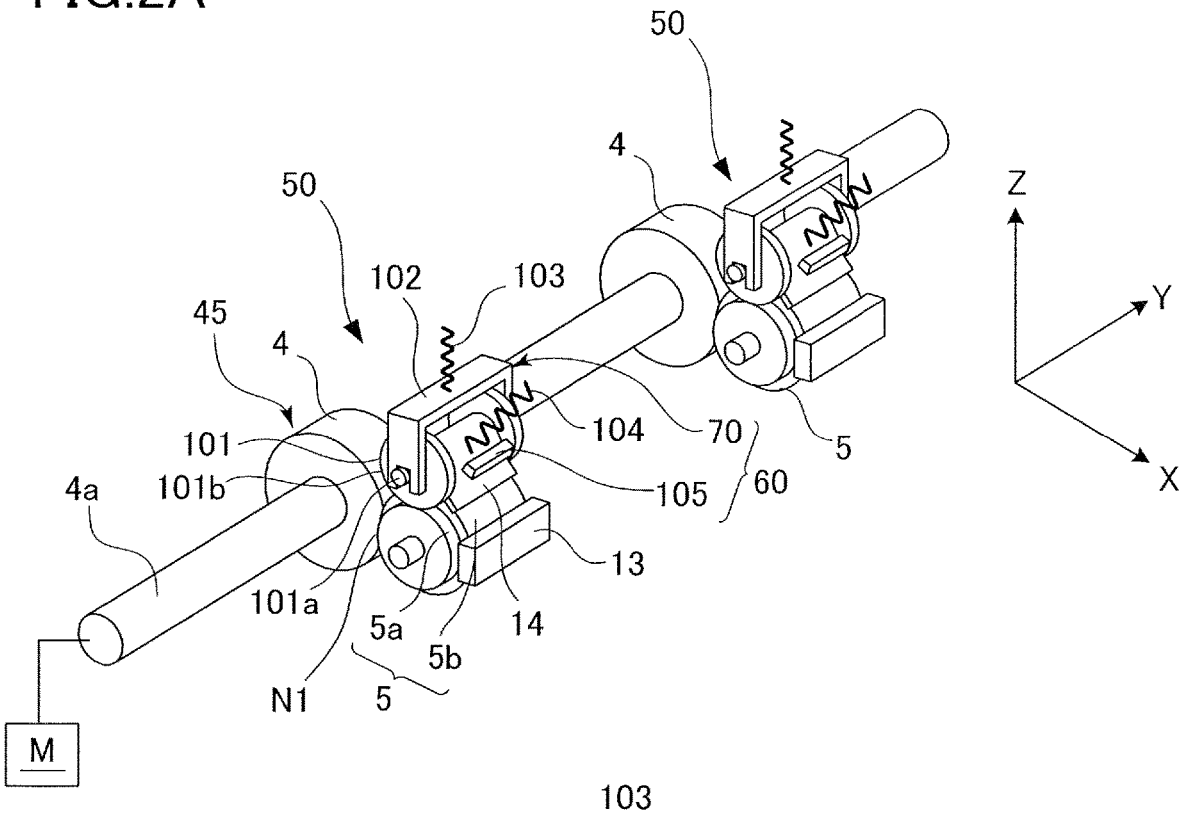
FIG. 2A is a perspective view illustrating a sheet conveyance apparatus.
Figure 2B:
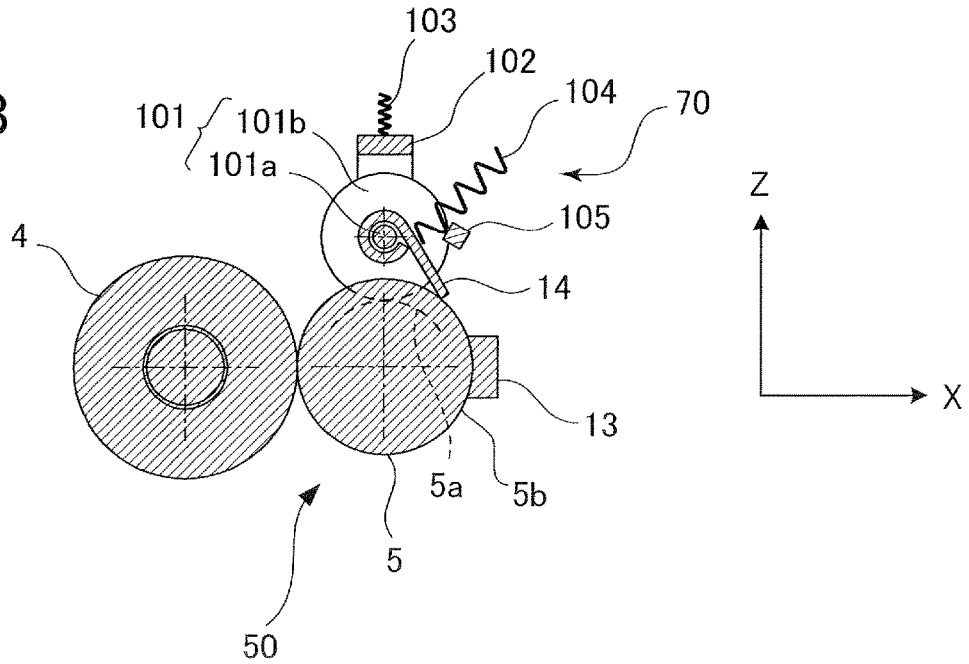
FIG. 2B is a sectional view illustrating the sheet conveyance apparatus.

As illustrated in FIGS. 2A and 2B, the contacting and separating mechanism 60 includes a transmitting portion 70 transmitting the driving force to the backflow preventing member 14 and an abutment portion 105 against which the rotating backflow preventing member 14 abuts. The transmitting portion 70 includes a driven roller 101 as a supporting portion driven to rotate by the driven roller 5 by sliding on the sliding surface 5*a* of the driven roller 5, a driven roller holder 102, and a spring 103. The driven roller 101 includes a rotation shaft 101*a* and a pair of disc members 101*b* fixed to the rotation shaft 101*a* and abutting against the sliding surfaces 5*a* on both sides of the sheet conveyance surface 5*b*. That is, the disc member 101*b* as a second engagement portion is in engagement with the sliding surface 5*a* as the first engagement portion and is driven to rotate.

The backflow preventing member 14 is rotatably supported by the rotation shaft 101*a* with a slight gap. The driven roller holder 102 supports the rotation shaft 101*a* of the driven roller 101 rotatably and slidably in an upward and downward direction (arrow Z direction in the drawing) and restricts an upward movement of the rotation shaft 101*a* at a predetermined position.

The spring 103 urges the driven roller holder 102 downward, that is, toward the driven roller 5, and the disc member 101*b* of the driven roller 101 contacts with the sliding surface 5*a* of the driven roller 5 with a predetermined pressure. The driving force of the motor M is transmitted to the backflow preventing member 14 via the drive shaft 4*a*, the driving roller 4, the driven roller 5, and the driven roller 101. More specifically, the driven roller 101 is rotated by being in engagement with the sliding surface 5*a* of the driven roller 5, and the backflow preventing member 14 integrally rotates with the rotation shaft 101*a* by a frictional force between the rotation shaft 101*a* of the driven roller 101 and the backflow preventing member 14. As described above, the rotation shaft 101*a* of the driven roller 101 supporting the backflow preventing member 14 is driven to rotate by the driven roller 5.

Operation of Backflow Preventing Member

Figure 3A:
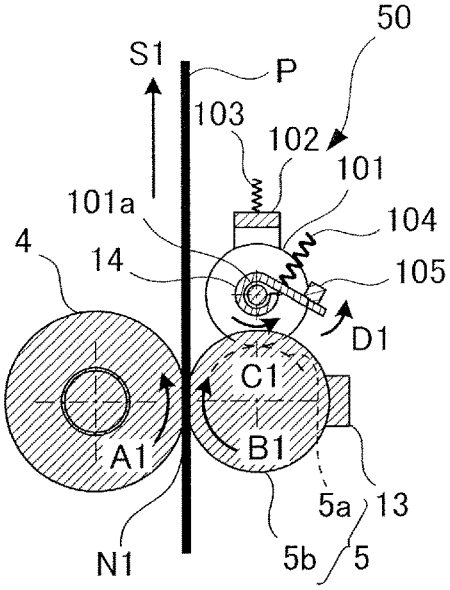
FIG. 3A is a sectional view illustrating a state where a sheet is conveyed by a conveyance nip.

Next, an operation of the backflow preventing member 14 will be described in detail with reference to FIG. 3. FIG. 3A illustrates a state where the sheet P is conveyed by an image forming job or the like. As illustrated in FIG. 3A, in a case where the driving roller 4 rotates in an arrow A1 direction, the driven roller 5 driven by the driving roller 4 rotates in the arrow B1 direction as the first direction and the sheet P is conveyed in an arrow S1 direction by the conveyance nip N1. Therefore, the sheet P is conveyed toward the transfer nip T1 (see FIG. 1) and an image is formed at the transfer nip T1 which is an image forming position.

The driven roller 101 is rotated in an arrow C1 direction by coming into contact with the sliding surface 5*a* of the driven roller 5 rotating in the arrow B1 direction. When the driven roller 101 rotates in the arrow C1 direction, the backflow preventing member 14 also rotates in an arrow D1 direction against the urging force of the spring 104 by the frictional force with the rotation shaft 101*a* of the driven roller 101. When abutting against the abutment portion 105 provided in the casing of the printer 1, the backflow preventing member 14 is kept separate from the sheet conveyance surface 5*b* of the driven roller 5. In this case, the rotation shaft 101*a* of the driven roller 101 rotates in the arrow C1 direction, but the backflow preventing member 14 is in sliding contact with the rotation shaft 101*a* and a posture is maintained in a state of abutting against the abutment portion 105.

Figure 3B:
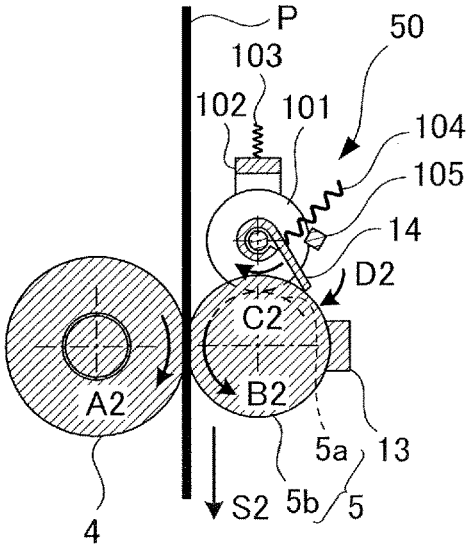
FIG. 3B is a sectional view illustrating a state where the sheet is pulled out in an opposite direction to a sheet conveyance direction.

FIG. 3B illustrates a state where the sheet P is pulled out in an arrow S2 direction opposite to the arrow S1 direction, that is, toward the feed roller 3 (see FIG. 1) by a jam processing operation or the like. As illustrated in FIG. 3B, when the sheet P is pulled out in the arrow S2 direction, the driving roller 4, the driven roller 5, the driven roller 101, and the backflow preventing member 14 rotate in a direction opposite to the rotation direction described in FIG. 3A, that is, the arrow A2, B2, C2, and D2 directions respectively.

As described above, when the driven roller 5 rotates in the arrow B2 direction as the second direction opposite to the arrow B1 direction, the backflow preventing member 14 rotates in the arrow D2 direction by the frictional force with the rotation shaft 101*a* of the driven roller 101, its own weight, and the urging force of the spring 104. Therefore, the backflow preventing member 14 reliably contacts with the sheet conveyance surface 5*b* of the driven roller 5. In this case, the rotation shaft 101*a* of the driven roller 101 rotates in the arrow C2 direction, but the backflow preventing member 14 is in sliding contact with the rotation shaft 101*a* and a posture is maintained in a state of abutting against the sheet conveyance surface 5*b* of the driven roller 5.

Figure 3C:
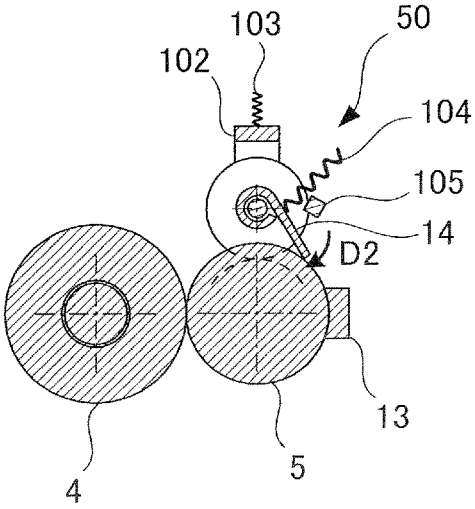
FIG. 3C is a sectional view illustrating a state where a driving roller and a driven roller are stopped.

FIG. 3C illustrates a state where the motor M (see FIG. 2A) is stopped and the driving roller 4, the driven roller 5, and the driven roller 101 are stopped. In this case, as illustrated in FIG. 3C, the backflow preventing member 14 is urged in the arrow D2 direction by its own weight and the urging force of the spring 104, and a posture is maintained in a state of abutting against the sheet conveyance surface 5*b* of the driven roller 5.

As described above, as illustrated in FIG. 3A, the backflow preventing member 14 is separated from the sheet conveyance surface 5*b* of the driven roller 5 when the driven roller 5 rotates in the arrow B1 direction in which the sheet P is normally conveyed. Therefore, the backflow preventing member 14 does not hinder a scraping operation of the paper dust by the sponge 13.

In addition, as illustrated in FIG. 3B, when the driven roller 5 rotates in the arrow B2 direction, the paper dust scraped by the sponge 13 rides on the sheet conveyance surface 5*b* of the driven roller 5 and sometimes moves toward the conveyance nip N1. However, the backflow preventing member 14 contacts with the sheet conveyance surface 5*b*, so that the paper dust on the sheet conveyance surface 5*b* can be reliably removed. Moreover, since the backflow preventing member 14 contacts with the sheet conveyance surface 5*b* without any gap, paper dust having a small particle size such as a filler (for example, calcium carbonate or talc) contained in the sheet P can also be scraped. Therefore, image defects due to the paper dust can be prevented. In addition, the paper dust on the sheet conveyance surface 5*b* is scraped, so that slipping of the sheet P at the conveyance nip N1 can be reduced and image defects such as image displacement at the transfer nip T1 can be prevented.

In addition, the contacting and separating mechanism 60 that causes the backflow preventing member 14 to abut against and separate from the sheet conveyance surface 5*b* has a simple mechanical configuration and the backflow preventing member 14 is rotated using the driving force transmitted from the driven roller 5, so that it is possible to provide the sheet conveyance apparatus 50 having high reliability with low cost.

Second Embodiment

Next, a second embodiment of the invention will be described, and the second embodiment is a modification of the configuration of the contacting and separating mechanism 60 of the first embodiment. Therefore, configurations similar to those of the first embodiment will be omitted or described by attaching the same reference numerals to the drawings.

Sheet Conveyance Apparatus

Figure 4A:
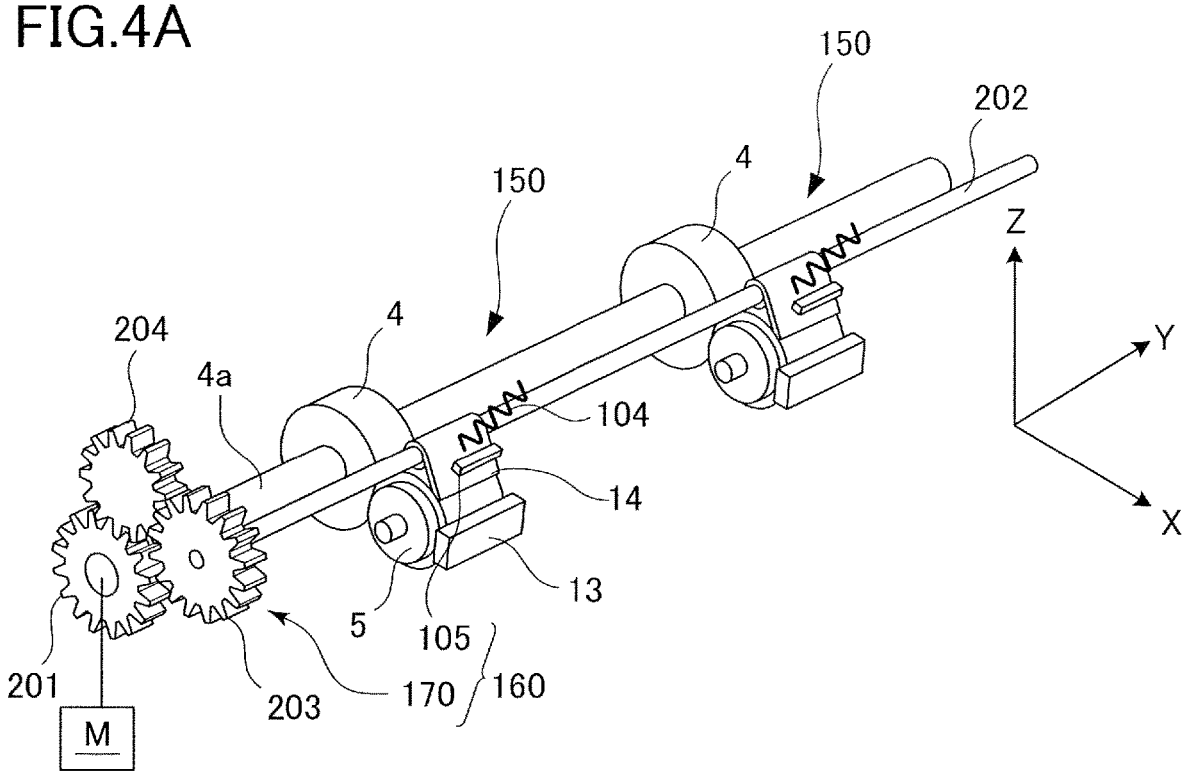
FIG. 4A is a perspective view illustrating a sheet conveyance apparatus according to a second embodiment.
Figure 4B:
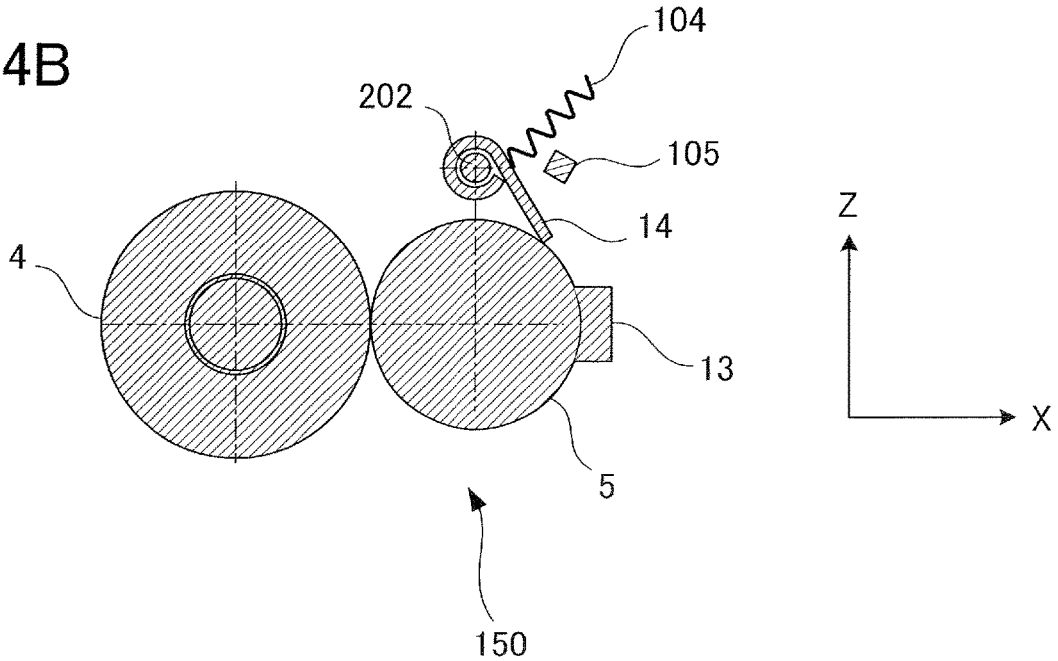
FIG. 4B is a sectional view illustrating the sheet conveyance apparatus.

As illustrated in FIGS. 4A and 4B, a sheet conveyance apparatus 150 includes a driving roller 4, a driven roller 5 driven to rotate by the driving roller 4, a sponge 13, a backflow preventing member 14, and a contacting and separating mechanism 160. The contacting and separating mechanism 160 includes a transmitting portion 170 transmitting a driving force of a motor M to the backflow preventing member 14, and an abutment portion 105.

The transmitting portion 170 includes a driving gear 201 as a first gear fixed to an end portion of a drive shaft 4*a* of the driving roller 4, an idler gear 204 as a second gear in engagement with the driving gear 201, an output gear 203 as a third gear in engagement with the idler gear 204, and a rotation shaft 202 fixed to the output gear 203. The backflow preventing member 14 is rotatably supported by the rotation shaft 202 as a supporting portion with a slight gap and is rotatable together with the rotation shaft 202 by a frictional force with the rotation shaft 202. In addition, the idler gear 204 is in engagement between the driving gear 201 and the output gear 203, so that a rotation direction of the backflow preventing member 14 is the same as a rotation direction of the driving roller 4, and is opposite to a rotation direction of the driven roller 5.

Operation of Backflow Preventing Member

Figure 5A:
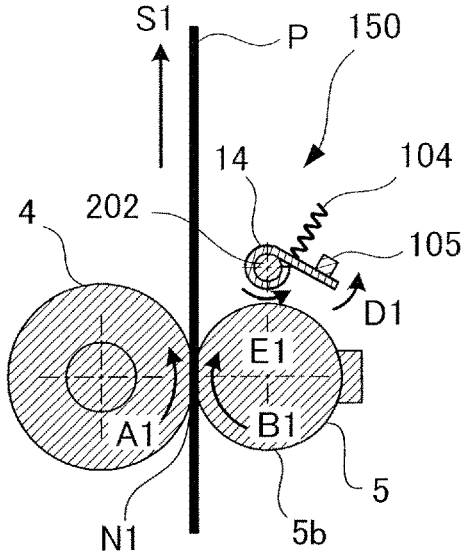
FIG. 5A is a sectional view illustrating a state where a sheet is conveyed by a conveyance nip.

Next, an operation of the backflow preventing member 14 will be described in detail with reference to FIGS. 5A to 5C. FIG. 5A illustrates a state where a sheet P is conveyed by an image forming job or the like. As illustrated in FIG. 5A, in a case where the driving roller 4 rotates in an arrow A1 direction, the driven roller 5 driven by the driving roller 4 rotates in an arrow B1 direction and the sheet P is conveyed by a conveyance nip N1 in an arrow S1 direction.

A driving force of a motor M driving the drive shaft 4*a* is transmitted to the rotation shaft 202 via the driving gear 201, the idler gear 204, and the output gear 203 (see FIG. 4A), and the rotation shaft 202 rotates in an arrow E1 direction. When the rotation shaft 202 rotates in the arrow E1 direction, the backflow preventing member 14 also rotates in the arrow D1 direction against an urging force of a spring 104 by a frictional force with the rotation shaft 202. When abutting against an abutment portion 105 provided in the casing of the printer 1, the backflow preventing member 14 is kept separate from a sheet conveyance surface 5*b* of the driven roller 5. In this case, the rotation shaft 202 rotates in the arrow E1 direction, but the backflow preventing member 14 is in sliding contact with the rotation shaft 202 and maintained in the posture in which it abuts against the abutment portion 105.

Figure 5B:
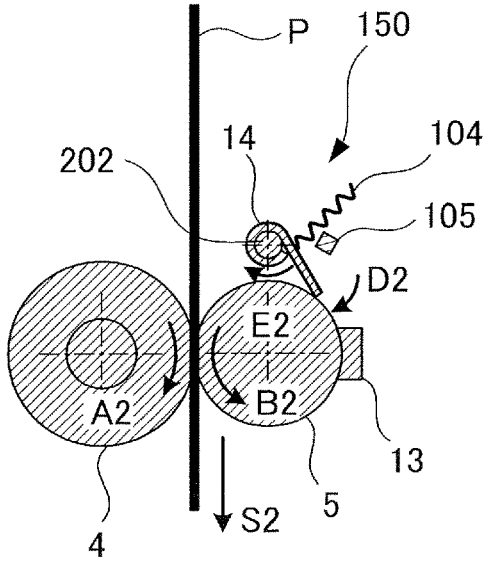
FIG. 5B is a sectional view illustrating a state where the sheet is pulled out in an opposite direction to a sheet conveyance direction.

FIG. 5B illustrates a state where the sheet P is pulled out by the jam processing operation or the like in an arrow S2 direction opposite to the arrow S1 direction, that is, toward the feed roller 3 (see FIG. 1). As illustrated in FIG. 5B, when the sheet P is pulled out in the arrow S2 direction, the driving roller 4, the driven roller 5, the rotation shaft 202, and the backflow preventing member 14 rotate in a direction opposite to the rotation direction described in FIG. 5A, that is, the arrow A2, B2, E2, and D2 directions, respectively.

As described above, when the driven roller 5 rotates in the arrow B2 direction opposite to the arrow B1 direction, the backflow preventing member 14 rotates in the arrow D2 direction by a frictional force with the rotation shaft 202, its own weight, and an urging force of the spring 104. Therefore, the backflow preventing member 14 reliably contacts with the sheet conveyance surface 5*b* of the driven roller 5. In this case, the rotation shaft 202 rotates in the arrow E2 direction, but the backflow preventing member 14 is in sliding contact with the rotation shaft 202 and maintained in the posture in which it contacts with the sheet conveyance surface 5*b* of the driven roller 5.

Figure 5C:
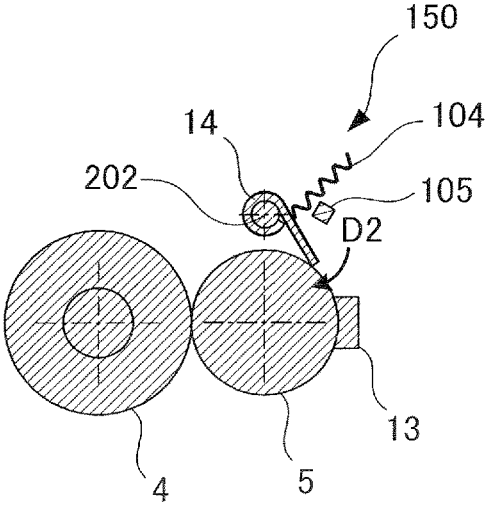
FIG. 5C is a sectional view illustrating a state where a driving roller and a driven roller are stopped.

FIG. 5C illustrates a state where the motor M (see FIG. 4A) is stopped and the driving roller 4, the driven roller 5, and the rotation shaft 202 are stopped. In this case, as illustrated in FIG. 5C, the backflow preventing member 14 is urged in the arrow D2 direction by its own weight and the urging force of the spring 104, and maintained in the posture in which it contacts with the sheet conveyance surface 5*b* of the driven roller 5.

As described above, as illustrated in FIG. 5A, when the driven roller 5 rotates in the arrow B1 direction in which the sheet P is normally conveyed, the backflow preventing member 14 is separated from the sheet conveyance surface 5*b* of the driven roller 5. Therefore, the backflow preventing member 14 does not hinder a scraping operation of paper dust by the sponge 13. In addition, as illustrated in FIG. 5B, when the driven roller 5 rotates in the arrow B2 direction, the backflow preventing member 14 contacts with the sheet conveyance surface 5*b*, so that the paper dust on the sheet conveyance surface 5*b* can be reliably removed.

In addition, in the backflow preventing member 14, since the driving force from the driving gear 201 driven by the motor M is transmitted, a rotation load applied to the driven roller 5 driven to rotate by the driving roller 4 is smaller than that of the first embodiment. Therefore, the driven roller 5 can be more smoothly rotated and load fluctuation when a trailing edge of the sheet P passes through the conveyance nip N1 is suppressed. As a result, conveyance shake of the sheet P at the transfer nip T1 can be reduced and image defects can be reduced.

Figure 6A:
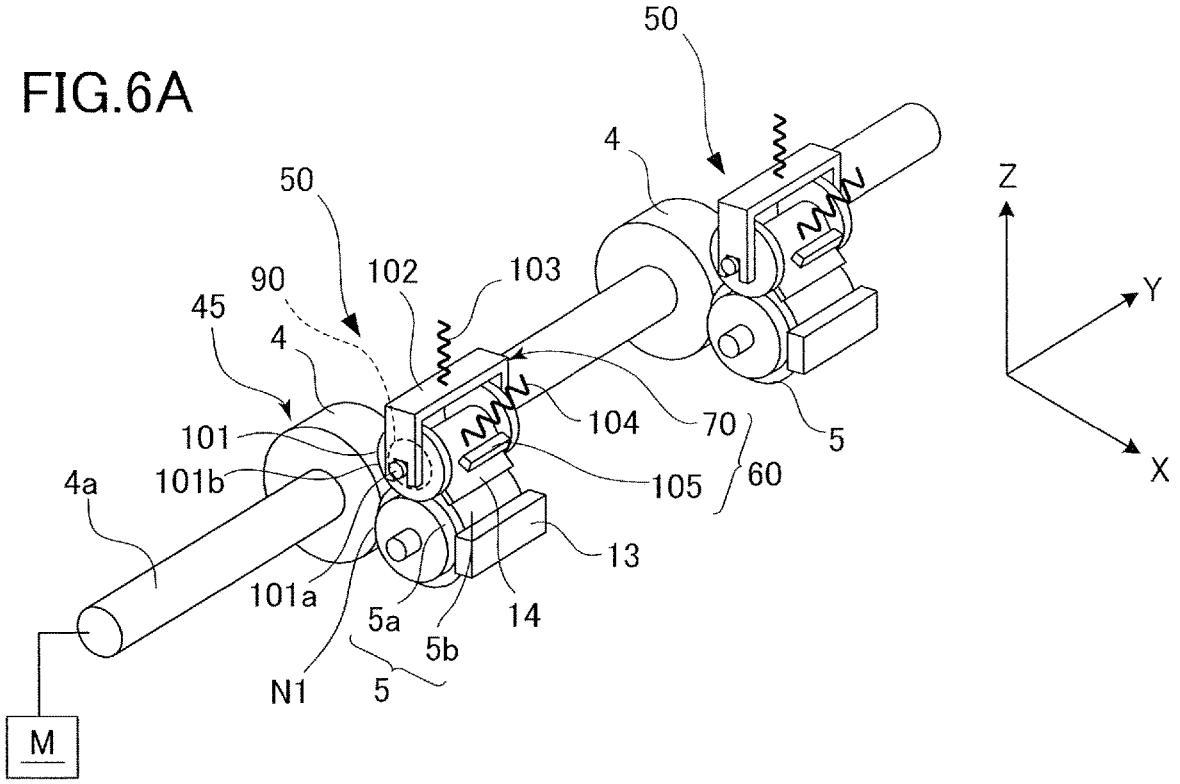
FIG. 6A is a perspective view illustrating a modification example of the first embodiment.
Figure 6B:
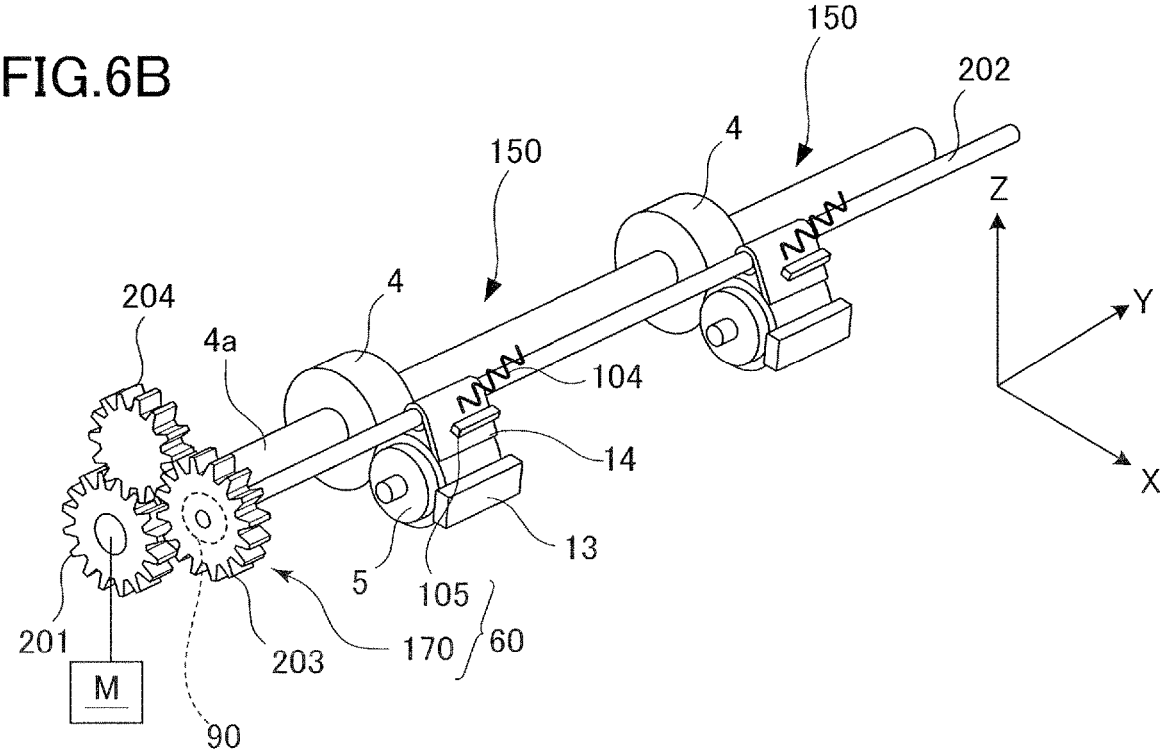
FIG. 6B is a perspective view illustrating a modification example of the second embodiment.

Moreover, in the first and second embodiments, a slight gap is provided between the rotation shafts 101*a* and 202, and the backflow preventing member 14, and the backflow preventing member 14 is rotatable relative to the rotation shafts 101*a* and 202, but the invention is not limited thereto. For example, as illustrated in FIG. 6A, a torque limiter 90 may be provided between the rotation shaft 101*a* and the disc member 101*b* of the driven roller 101, and the backflow preventing member 14 may be fixed to the rotation shaft 101*a*. In addition, as illustrated in FIG. 6B, the torque limiter 90 may be provided between the output gear 203 and the rotation shaft 202, and the backflow preventing member 14 may be fixed to the rotation shaft 202.

In a state where the backflow preventing member 14 is separated from the abutment portion 105, or the backflow preventing member 14 is separated from the sheet conveyance surface 5*b*, the torque limiter 90 transmits a driving force to the rotation shafts 101*a* and 202. In addition, in a state where the backflow preventing member 14 abuts against the abutment portion 105 or the sheet conveyance surface 5*b*, the torque limiter 90 does not transmit the driving force to the rotation shafts 101*a* and 202. Therefore, it is possible to realize the operation of the backflow preventing member 14 similar to those of the first and second embodiments. Moreover, the torque limiter 90 is not limited to the configuration described above but may be provided anywhere as long as it is provided in a driving path for transmitting the driving force to the rotation shafts 101*a* and 202.

In addition, in the first and second embodiments, the backflow preventing member 14 is rotated by using the driving force of the motor M for driving the conveyance portion 45, but the invention is not limited thereto and the backflow preventing member 14 may be rotated by a drive source other than the motor M.

In addition, the spring 103 is provided in the driven roller holder 102 and the casing of the printer 1, and the spring 104 is provided between the backflow preventing member 14 and the casing of the printer 1, but the invention is not limited thereto. For example, the springs 103 and 104 may be provided between the backflow preventing member 14 and a driven roller holder 102 which is described later. In addition, the abutment portion 105 may not be provided in the casing but be provided in the driven roller holder 102 or the like. In addition, the backflow preventing member 14 is urged toward the sheet conveyance surface 5*b* of the driven roller 5 by the spring 104 and its own weight but may be urged only by its own weight without the spring 104.

In addition, materials of the sponge 13 and the backflow preventing member 14 are not limited, and the sponge 13 may be made by a rubber-like elastic body or a member using MYLAR, and the backflow preventing member 14 may be made by a sponge-like or rubber-like elastic body.

In addition, the sponge 13, the backflow preventing member 14, and the contacting and separating mechanisms 60 and 160 may be provided to remove paper dust of the rotary member other than the driven roller 5. For example, the sponge 13, the backflow preventing member 14, and the contacting and separating mechanisms 60 and 160 may be provided to remove paper dust of the feed roller 3, the driving roller 4, and the sheet discharge roller pair 11. In addition, a member forming the conveyance nip together with the rotary members is not limited to the rotary member such as a roller or a belt, but for example, may be a member which does not rotate like the separating pad 33.

In addition, in any of the embodiments described above, the printer 1 of the electrophotographic system is described, but the invention is not limited thereto. For example, the invention can be applied to an image forming apparatus of an ink jet system for forming an image on a sheet by discharging an ink liquid from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-082573, filed Apr. 23, 2018, which is hereby incorporated by reference herein in its entirety.

What is claimed is:

1. A sheet conveyance apparatus comprising:

a conveyance portion comprising a rotary member, and a counter member facing the rotary member so as to form a conveyance nip together with the rotary member, the conveyance portion being configured to convey a sheet at the conveyance nip by the rotary member rotating in a first direction;

a first contact member configured to come into contact with a surface of the rotary member at a first position;

a second contact member configured to come into contact with the surface of the rotary member at a second position located downstream of the conveyance nip and upstream of the first position in the first direction; and a contacting and separating mechanism configured to abut the second contact member against the surface of the rotary member and separate the second contact member from the surface of the rotary member, the contacting and separating mechanism causing the second contact member to separate from the surface of the rotary member when the rotary member rotates in the first direction, and causing the second contact member to abut against the surface of the rotary member when the rotary member rotates in a second direction opposite to the first direction, wherein the contacting and separating mechanism comprises:

a transmitting portion configured to transmit a driving force for driving the conveyance portion to the second contact member; and an abutment portion against which the second contact member abuts in a case where the second contact member is separated from the surface of the rotary member when the rotary member rotates in the first direction, and wherein the transmitting portion comprises a supporting portion that is driven and rotated by the rotary member and rotatably supports the second contact member.

2. The sheet conveyance apparatus according to claim 1, wherein the rotary member comprises a roller portion that comes into contact with the sheet to convey the sheet, and a first engagement portion that is disposed outside the roller portion in an axial direction of the rotary member and rotates together with the roller portion, and the supporting portion comprises a second engagement portion that is engaged with the first engagement portion and driven and rotated, and a rotation shaft that is supported by the second engagement portion and rotatably supports the second contact member.

3. The sheet conveyance apparatus according to claim 1, wherein the second contact member is integrally rotatable with the supporting portion by a frictional force in a state where the rotary member rotates in the first direction and the second contact member does not abut against the abutment portion, and is rotatable relative to the supporting portion in a state where the rotary member rotates in the first direction and the second contact member abuts against the abutment portion.

4. The sheet conveyance apparatus according to claim 1, wherein the second contact member is fixed to the supporting portion, the transmitting portion comprises a torque limiter provided in a driving path for transmitting the driving force to the supporting portion, and the torque limiter does not transmit the driving force to the supporting portion in a state where the rotary member rotates in the first direction and the second contact member abuts against the abutment portion.

5. A sheet conveyance apparatus comprising:

a conveyance portion comprising a rotary member, and a counter member facing the rotary member so as to form a conveyance nip together with the rotary member, the conveyance portion being configured to convey a sheet at the conveyance nip by the rotary member rotating in a first direction;

a first contact member configured to come into contact with a surface of the rotary member at a first position;

a second contact member configured to come into contact with the surface of the rotary member at a second position located downstream of the conveyance nip and upstream of the first position in the first direction;

a contacting and separating mechanism configured to abut the second contact member against the surface of the rotary member and separate the second contact member from the surface of the rotary member, the contacting and separating mechanism causing the second contact member to separate from the surface of the rotary member when the rotary member rotates in the first direction, and causing the second contact member to abut against the surface of the rotary member when the rotary member rotates in a second direction opposite to the first direction, a drive shaft on which the counter member is rotatably supported; and a drive source configured to drive the drive shaft, wherein the contacting and separating mechanism comprises:

a transmitting portion configured to transmit a driving force for driving the conveyance portion to the second contact member; and an abutment portion against which the second contact member abuts in a case where the second contact member is separated from the surface of the rotary member when the rotary member rotates in the first direction, and wherein the transmitting portion comprises a supporting portion that is rotated by a driving force transmitted from the drive source without passing through the rotary member and rotatably supports the second contact member.

6. The sheet conveyance apparatus according to claim 5, wherein the transmitting portion comprises a first gear fixed to the drive shaft, a second gear in engagement with the first gear, and a third gear supported by the supporting portion and in engagement with the second gear.

7. The sheet conveyance apparatus according to claim 5, wherein the second contact member is integrally rotatable with the supporting portion by a frictional force in a state where the rotary member rotates in the first direction and the second contact member does not abut against the abutment portion, and is rotatable relative to the supporting portion in a state where the rotary member rotates in the first direction and the second contact member abuts against the abutment portion.

8. The sheet conveyance apparatus according to claim 5, wherein the second contact member is fixed to the supporting portion, the transmitting portion comprises a torque limiter provided in a driving path for transmitting the driving force to the supporting portion, and the torque limiter does not transmit the driving force to the supporting portion in a state where the rotary member rotates in the first direction and the second contact member abuts against the abutment portion.

9. The sheet conveyance apparatus according to claim 1, wherein the second contact member is urged toward the surface of the rotary member in a state where the rotary member is stopped.

10. The sheet conveyance apparatus according to claim 1, wherein the counter member is a driving roller, and the rotary member is a driven roller that is driven and rotated by the driving roller.

11. The sheet conveyance apparatus according to claim 1, wherein the first contact member and the second contact member come into contact with the surface of the rotary member to remove paper dust adhering to the surface.

12. An image forming apparatus comprising:

the sheet conveyance apparatus according to claim 1; and an image forming unit configured to form an image on a sheet at an image forming position.

13. The image forming apparatus according to claim 12, wherein the conveyance portion is disposed upstream of the image forming position in a sheet conveyance direction.

* * * * *